US007221260B2

(12) United States Patent
Berezowski et al.

(10) Patent No.: US 7,221,260 B2
(45) Date of Patent: May 22, 2007

(54) MULTI-SENSOR FIRE DETECTORS WITH AUDIO SENSORS AND SYSTEMS THEREOF

(75) Inventors: Andrew G. Berezowski, Wallingford, CT (US); Anthony E. Faltesek, Roseville, MN (US); Lee Tice, Barlett, IL (US)

(73) Assignee: Honeywell International, Inc., Morristown, NJ (US)

( * ) Notice: Subject to any disclaimer, the term of this patent is extended or adjusted under 35 U.S.C. 154(b) by 286 days.

(21) Appl. No.: 10/719,116

(22) Filed: Nov. 21, 2003

(65) Prior Publication Data

US 2005/0110632 A1 May 26, 2005

(51) Int. Cl.
*G08B 17/00* (2006.01)
*G08B 19/00* (2006.01)
*H04R 29/00* (2006.01)

(52) U.S. Cl. ..... 340/286.05; 340/521; 340/522; 340/566; 340/577; 340/588; 340/332; 340/628; 381/56; 381/58; 367/199

(58) Field of Classification Search ..... 340/286.05, 340/539.26, 539.22, 539.27, 521, 522, 577, 340/588, 332, 566; 381/56, 58
See application file for complete search history.

(56) References Cited

U.S. PATENT DOCUMENTS

| | | | | |
|---|---|---|---|---|
| 4,417,235 | A * | 11/1983 | Del Grande | 340/531 |
| 4,785,283 | A * | 11/1988 | Yuchi | 340/501 |
| 4,959,638 | A * | 9/1990 | Palmer | 340/577 |
| 5,659,292 | A * | 8/1997 | Tice | 340/522 |
| 2005/0105743 | A1 * | 5/2005 | Faltesek et al. | 381/82 |

* cited by examiner

*Primary Examiner*—Donnie L. Crosland
(74) *Attorney, Agent, or Firm*—Welsh & Katz, Ltd.

(57) ABSTRACT

An ambient condition detector incorporates an audio transducer for discrimination between alarm and non-alarm conditions. The transducer can provide occupancy information. In addition, a monitoring system can graphically present information as to the location of individuals, such as fire fighters, in the region.

23 Claims, 2 Drawing Sheets

MULTI-SENSOR FIRE DETECTORS WITH AUDIO SENSORS AND SYSTEMS THEREOF

FIELD OF THE INVENTION

The invention pertains to systems and method for monitoring regions. More particularly, the invention pertains to such systems and method which incorporate audio feedback information indicative of alarm conditions.

BACKGROUND OF THE INVENTION

It has been recognized that early detection of fires has great merit. The earlier a fire is detected, the earlier the fire department is called, and the earlier the department can start to fight the fire. However, attempts to increase the speed of detection can also run the risk of increasing the number of false positive alarms. So increasing the speed of detection while minimizing false positive alarms, or lowering the level of false positive alarms is very desirable.

Smoke detectors indicate where there is smoke in a region. As smoke spreads away from a fire, only a few of the alarming smoke detectors are near the fire. The faster the location of the actual fire can be located, the faster the fire fighters can mount an attack. It is desirable to be able to differentiate between smoke and fire in a system that is in alarm.

Another problem at fire scenes is that the location of trapped civilians and of fire fighters is often not known. It often is the case that fire fighters are unsure about whether there are trapped civilians in a building. Civilians are usually not issued special safety equipment before an emergency to protect them in an emergency. When in involved buildings, fire fighters are often out of contact with fire commanders due to radio interferences and blind spots.

There this is a continuing need to be able to locate and monitor the positions of fire fighters and victims in fires, explosions, and other emergencies as well as to locate and diagnose fires. Further, there is a continuing need to be able to detect and track fire progress in a region being monitored.

DETAILED DESCRIPTION OF THE EMBODIMENTS

Figure 1:
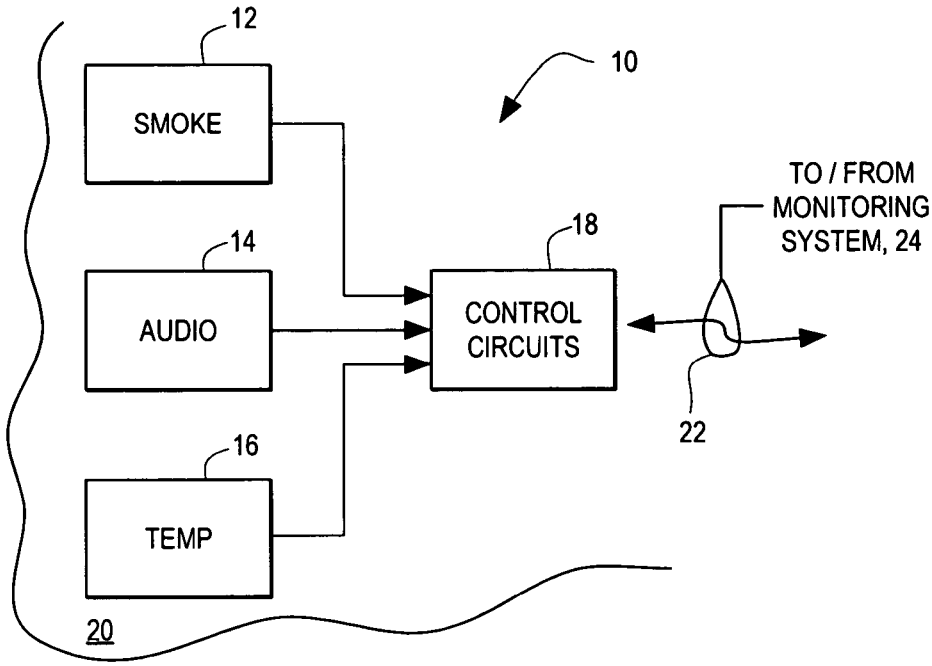
FIG. 1 is a block diagram of an ambient condition detector in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Embodiments of the present invention detect the sound of fire or flame. An audio transducer in an ambient condition detector could be used to detect such sounds.

The detector's on-board processor could be loaded with characteristic flame signatures. When the detector is able to detect some sounds that match the signatures, it could go into alarm.

If lower levels of false positive alarms are desired, the detector could wait for confirmation from other local sensors such as flame, smoke or temperature before the detector itself goes into alarm. If few false positives, but earlier detection are desired, the first sensor to alarm could increase the sensitivity of the other sensors. This heightened mode of sensing could cause more sensitive, and quicker reactions in the other sensors. If this heightened sensing mode showed a second sensor in alarm within a set time period after the first sensor alarmed, the detector could then alarm and notify the region's protection system. If a second sensor doesn't alarm within a set period, the detector could revert out of the trouble state which was caused by the first alarm, to a normal state.

Audio signals could be used in detecting flames in the early stage of development. Audio signals could also be used to adjust operational parameters of detectors monitoring the region.

Audio transducers can also be used in differentiating between smoke and fire. In addition, if a heat sensor is incorporated into the detector and periodically outputs temperatures during a fire rather than just alarming at a set alarm point, that information could be useful to fire fighters. With a graphical user interface, the extent of the smoke cloud can be evaluated and, the extent of the flames, smoke and the rising temperatures in the region can be visually displayed. Additional information about fire location that fire fighters could receive would help them to suppress the fire more quickly.

In one embodiment, fire detectors could incorporate audio transducers. Civilians or fire fighters could also use the microphones to identify their location, to report that they are in trouble, or to convey information about the fire or other information back to the fire commander. Their location would be easily determined by identifying the transducer that picks up their message at the loudest level. If fire sound is loud at that location, sound filtering could be activated to filter out fire sounds when voices were heard.

Fire teams could periodically call out an identifying code. This information would be picked up by a speech recognition module in the region's monitoring system to keep the incident commander informed as to the team's whereabouts. The commander could also use traditional radios, or the PA system, to call back to fire teams or victims and inform them of where they are, and how they need to navigate to get to the fire, out get out of the building.

Audio signatures of different types of fires could be pre-stored in the individual detectors, and also at the fire or regional monitoring system. The detectors, as well as the monitoring system could incorporate processing circuits to process the audio, such as the fire sounds. The system would not activate until a combination of two smoke detectors, sprinkler flow sensors, other fire sensors, or the audio sensors had gone into alarm. Only when the system was activated could the monitoring system start to access sound sent to it from individual speaker/microphone assemblies. This feature would assure that there is no intrusion into individual privacy in a region or building.

Once the system was activated, the detectors could start sending signals back to the system for situation assessment analysis, reporting on the user display, and allowing fire fighters direct access to sounds picked up by the microphones. The system, could then gather sounds from all the spaces where there are such detectors on a regular basis.

In the presence of a fire, there may be a great deal of noise. A speech recognition module might have difficulty understanding what was being said, even with sound filtering to filter out fire noise. A replay mode could then be engaged that allowed a listener to reply a recording of the last three items in a certain speaker zone. The zone where the activity is happening could light up on a visual user interface.

Each recording could be time stamped to allow easy differentiation. Such a manual mode could be an alternate to automatic signal processing. The manual mode allows fire commanders to listen directly to the sounds the fire is making in different spaces, and carry out diagnosis by identifying individual sounds.

A user interface could include a touch screen or an array of buttons to identify different areas and cluster transducers. A system in accordance with the invention could have an automatic user interface that would show the location of fire teams, or unidentified persons, in the location that their sound was last detected. An audio tracking algorithm could also be used to track each source of sound and show their progress as they move through the building. This display would help fire commanders keep up to date on where their fire teams are, and where they have come from in the facility. It would also identify probable civilians, their location, and whether they are still moving.

The detectors would fail at some point as the space they are in burns. A temperature sensor could be included to report this fact. This sensor could provide readings once the system is activated, or could act as a continuous monitor of building temperatures. Once the system is activated by a smoke sensor or other sensor, it could start reporting temperatures and track where temperatures are rising. The actual rising temperatures during a fire could be recorded by location and displayed for fire commanders.

This heat sensor could also act as a detector monitor. If a heat sensor failed after the system had been activated, the system could assume that it had failed due to being overheated. The system would also be able to call that conclusion into doubt if relatively low temperature readings had been recorded just prior to failure. The system could partially self-diagnose by checking to see if other detectors on the same power source or data lines are also out of operation.

Alternatively, the temperature sensing capability in such detectors could be used for building operation purposes in non-alarm states. Temperature variation and occupant dissatisfaction with temperature are two problems that facility managers face. The temperature sensors in detectors could be used to continuously monitor environmental conditions in the region or building. This would be useful since there might be more temperature sensors in the detectors than there are thermostats in zoned buildings. Very few of the thermostats are able to transmit their readings to a central location.

An integrated building control and fire safety system could monitor room temperatures at many locations, determine where temperatures are drifting from set points, and help diagnose deficient performance in HVAC (heating, ventilation, and air conditions) air delivery. Since the balancing, or thorough adjustment, of HVAC systems is expensive and happens infrequently in large buildings, gaining information on HVAC air delivery performance could enable making minor adjustments to improve performance. This ability would help facility managers to more consistently deliver the temperatures their customers want.

FIG. 1 illustrates a block diagram of a detector 10 in accordance with the invention. Ambient condition detector 10 incorporates a fire or smoke sensor 12, an audio input transducer, such as a microphone, 14 and an optional temperature sensor 16. Outputs of the sensors 12, 16 and transducer 14 are coupled to detector control circuits 18.

The circuitry elements 12–18 can be carried in a housing 20 and located in a region R to be monitored. Control circuits 18 communicate with a remote monitoring system via communications medium 22 which could be wired or wireless without limitation.

As noted above, outputs from audio transducer 14 can be processed by control circuitry 18 to detect sounds of flame or fire. Additionally, the thermal sensor 16 can be used as a supplement to outputs from the smoke sensor 12 and audio transducer 14.

Speech input from individuals in the vicinity of the detector 10 could be detected by transducer 14 and processed in control circuits 18. The outputs pertaining to detected speech could be coupled by medium 22 to monitoring system 24 to provide feedback as to the location of responders such as fire fighting personnel in the region being monitored.

The outputs from the audio transducer 14 can be analyzed by the local control circuits 18 or the monitoring system 24 and compared to normal expected sounds in the area of the detector 10. The response of the detector 10 can be altered dependent on the received sounds and the patterns of the sounds. Alteration can include alarm thresholds, changing filtering or smoothing characteristics, delays or the like all without limitation.

If the received audio indicates that the region in the vicinity of the detector 10 is occupied and there are no indications of a fire or other alarm condition, control circuitry 18 can reduce the sensitivity to signals received from smoke sensor 12 or thermal sensor 16 to reduce nuisance alarms or false positives. The outputs from audio transducer 14 can also be used as supplemental inputs indicative of occupancy or activity in the region of detector 10 to secure the lighting or HVAC systems. Alternately, when the incoming audio indicates that the vicinity of the detector is not occupied, the sensitivity can be increased.

Figure 2:
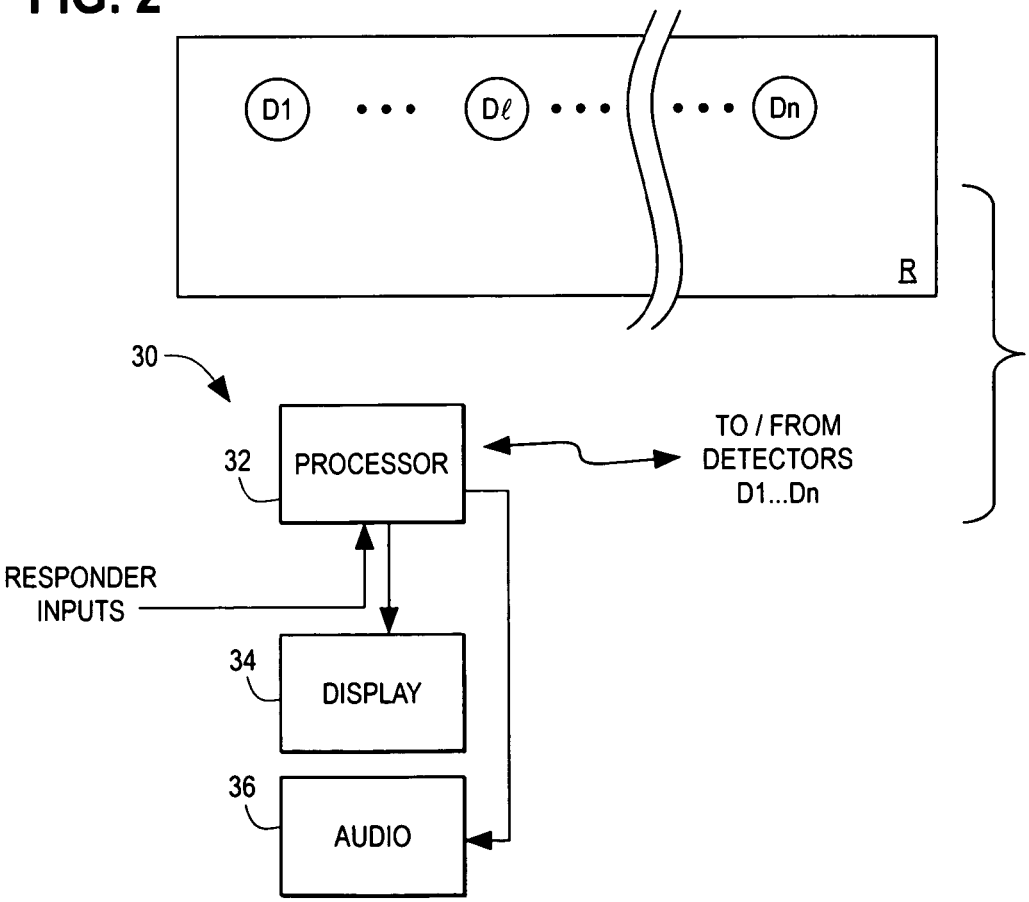
FIG. 2 is a block diagram of a monitoring system which incorporates the detector of FIG. 1.

FIG. 2 is a block diagram of a system 30 for monitoring a region R. A plurality of detectors D1 . . . Dv corresponding to the detector 10, are mounted in the region R. The detectors D1 . . . Dv are in bi-directional communication with a processor 32 of the system 30. System 30 could, for example, be part of a fire alarm control panel.

The processor 32 is coupled to a visual display 34 and an audio output transducer, such as a speaker 36. Responder inputs can be received at processor 32 via a touch screen on the display 34, keyboard switches all and the like, all without limitation.

The speech of fire fighters in the region R in the vicinity of detectors D1 . . . Dv could be sensed using the respective audio transducers 14 and signals indicative thereof provided to processor 32. Such signals could specify the location of the various fire fighters which in turn could be presented on display 34.

The system 30 could be designed so that it would not activate and start monitoring outputs from the audio transducers 14 until a combination of two or more ambient condition detectors such as smoke detectors, sprinkler flow sensors, other fire sensors or other audio sensors have gone into alarm. The processor 32 can also incorporate speech recognition software to improve the ability of an individual in the vicinity of speaker 36 to understand what is being said even in the presence of noise from the fire.

Processor 32 can incorporate location defining software responsive to the outputs of detectors D1 . . . Dv to show the location of smoke, fire, firefighting personnel or unidentified persons in the region R.

Audio tracking can be implemented at processor 32 to respond to changing inputs at the transducer 14 and a respective detectors D1 . . . Dv as firefighting personnel or other individuals move through the region R being monitored. Additionally, processor 32 can respond to failures in the respective thermal or temperature sensor 16 as the fire burns or destroys the respective detectors.

It will be understood that the audio signals from the respective transducers 14 can be processed or filtered for example to eliminate substantially constant noise from adjacent machines or external sources. The details of such processing are not limitations of the present invention.

In one embodiment, the audio processing software in processor 32 could ascertain whether or not signals being received from the respective detectors D1 . . . Dv were indicative of normal, non-alarm indicating audio associated with such detectors or alternately whether the audio being received indicated that the space adjacent the respective detectors was unoccupied or whether sounds emanating therefrom were indicative of an alarm condition. Where the adjacent spaces are relatively quiet, sensitivity of the respective detector could be increased. Where normal activity is indicated in the vicinity of the various detectors vis-à-vis, sensitivity can be decreased. Depending on the profile or signature of the audio being sensed, specific adjustments to the respective detector sensitivity could be made.

Figure 3A:
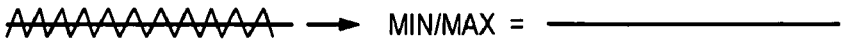
FIGS. 3A, 3B and 3C illustrate one form of processing of received audio.
Figure 3B:
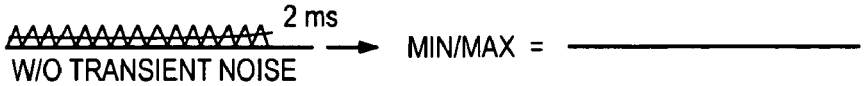
Figure 3C:
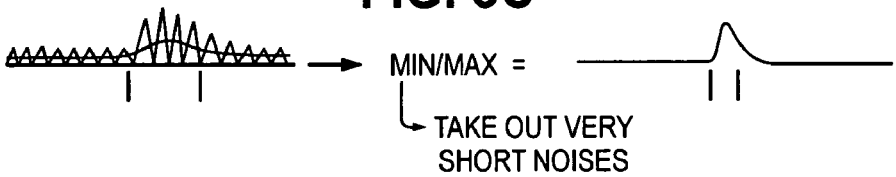

FIG. 3A, illustrates representative audio signals, such as might be present in a region being monitored, and, incident on the audio transducers, such as for example microphone 14. Such signals could be processed directly or rectified and then processed. FIG. 3A is an unrectified signal. FIG. 3B is a rectified representation of FIG. 3A. FIGS. 3A and 3B further illustrate representative processing of the incident audio where a ratio of a minimum value to a maximum value is formed. In FIG. 3C, rectified audio has been processed by forming a ratio of minimum to maximum values to take out noise or audio of very short duration.

Figure 4A:
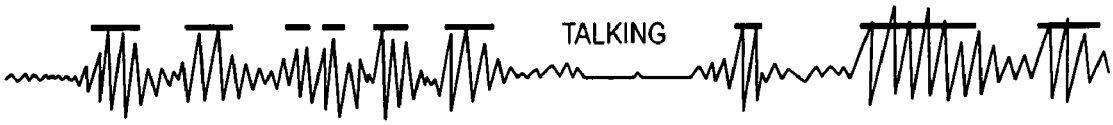
FIGS. 4A, 4B and 4C illustrate another form of processing of received audio.
Figure 4B:
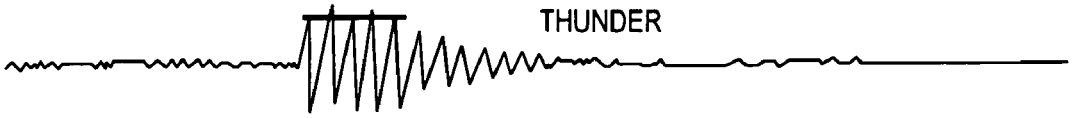
Figure 4C:
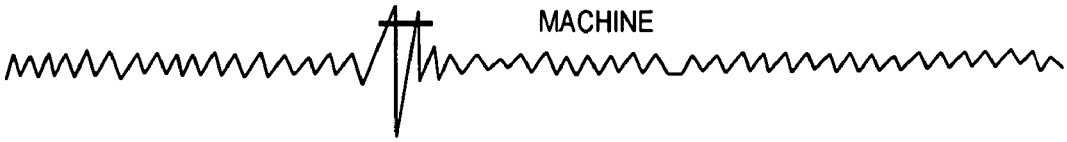

FIGS. 4A–4C illustrate alternate forms of audio processing. For example, FIG. 4A illustrates vocal sounds due to individuals in the region R speaking to one another. The number and spacings of excursions above a threshold can be counted or accumulated so as to be able to distinguish between normal speaking audio, FIG. 4A, natural exterior sounds such as thunder, FIG. 4B or machine sounds, FIG. 4C. It will be understood that other forms of processing of incident audio either at the respective detectors, such as detector 10 or at the common processing system 30 come within the spirit and scope of the present invention.

As discussed above, processes, for example as in FIG. 4A, can be used to establish the presence of normal human activity in the region R. In such instances, the sensitivity of the respective detectors can be decreased. In the absence of normal audio, where the region R becomes quiet, the sensitivity of the various detectors can be increased. Similarly, natural external noises such as thunder or normal machine noises in the region R can be filtered so as to not effect the sensitivity setting.

Sensitivity adjustments can be fixed for minimum pre-set periods of time so as to remain relatively constant in the presence of occasional intermittent noise. At the end of the time interval, such as 15–20 minutes, sensitivity can again be increased given relative quiet in the region R. Continuous levels of background noise can be filtered out as would be known by those of skill in the art.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A multi-sensor detector comprising:

at least one smoke sensor;

at least one transducer for converting an incident acoustic signal to an electrical signal;

control circuits coupled to the at least one sensor and the electrical signal for establishing the presence for fire condition in the vicinity of the transducer, based at least in part on incident acoustic signals emitted by an on-going fire present in a predetermined local region adjacent to the transducer; and an interface for communication of representations of at least portions of the electrical signal to a displaced monitoring system for audio presentation.

2. A detector as in claim 1 which includes a thermal sensor coupled to the control circuits.

3. A detector as in claim 1 where the control circuits include pre-stored fire profiles and circuitry for matching at least some of the electrical signals with at least one profile.

4. A detector as in claim 1 which includes pre-stored instructions for communicating, via the interface, information as to presence of a fire condition based in part on the electrical signal.

5. A detector as in claim 4 which includes instructions for fire profile processing to establish flame location.

6. A detector as in claim 4 which includes instructions for conveying received audio inputs from individuals in the vicinity of the transducers to the displaced system.

7. A detector as in claim 1 which includes instructions to alter a fire condition determining parameter in response to the electrical signal.

8. A detector as in claim 6 which includes instructions for altering a sensitivity parameter of the smoke sensor in response to the electrical signal.

9. A detector as in claim 8 which includes a second sensor, coupled to the control circuits, for monitoring ambient temperature.

10. An alarm system comprising:

a plurality of ambient condition detectors, at least some of the detectors each incorporate an audio transducer configured to provide fire related and occupancy information as well as a smoke sensor;

a control unit, in bi-directional communication with the detectors, the control unit including instructions for monitoring outputs of the audio transducers for establishing information pertaining to the location of individuals in the vicinity of respective transducers and which includes instructions for tracking movements of individuals in the vicinity of respective transducers.

11. A system as in claim 10 which includes instructions for monitoring detector outputs indicative of audio based fire profiles to establish fire locations and direction of travel.

12. A system as in claim 10 which includes instructions for monitoring transducer outputs indicative of individuals in the vicinity and for presenting graphical images reflective thereof.

13. A system as in claim 10 which includes software for evaluating the presence of alarm conditions, at least in part, in response to outputs from the transducers.

14. A system as in claim 10 which includes software for evaluating the presence of alarm conditions, at least in part, in response to thermal conditions in the vicinity of respective detectors.

15. A system as in claim 13 for adjusting at least one operational parameter of some of the smoke sensors in response to audio transducer output.

16. A system as in claim 15 where detector sensitivity is altered in response to audio transducer output.

17. A system as in claim 15 where at least some of the detectors include heat sensors.

18. A system as in claim 15 where the control unit includes instructions for displaying fire development in the vicinity of respective detectors.

19. A method of monitoring a region comprising:

evaluating a plurality of audio indicia from the region;

adjusting operational parameters of a plurality of ambient condition detectors in the region in response to at least some of the audio indicia determining at least in part in response to the audio indicia, if a fire condition is present somewhere in the region; and determining at least in part in response to the audio indicia if the region is occupied.

20. A method as in claim 19 including:

providing a graphical display of a developing fire condition in the region.

21. A bi-directional communication system comprising:

a plurality of variable sensitivity smoke detectors transmitting indications of respective environmental conditions;

at least one device transmitting audible indications from an audio transducer;

control circuitry receiving the environmental condition indications and audible indications from the audio transducer;

wherein the control circuitry uses the indications from the transducer for establishing the location of sound generating activities within a region and uses the environmental condition indications for establishing the location of environmental conditions within the region; and display circuitry for indicating the environmental condition and movement of sound generating activities within the region.

22. A system as in claim 21 which includes audio output circuitry, adjacent to the display circuitry for emitting audio corresponding to received audible indications.

23. A system as in claim 22 which includes circuitry for processing received audible indications prior to emitting corresponding audio.

* * * * *